US006086214A

United States Patent [19]

Ridge

[11] Patent Number: 6,086,214

[45] Date of Patent: Jul. 11, 2000

[54] WIND POWERED LAMP

[76] Inventor: Philip G. Ridge, 36 Maher Avenue, Toronto, Ontario, Canada, M6P 1S6

[21] Appl. No.: 09/141,532

[22] Filed: Aug. 27, 1998

[51] Int. Cl.[7] ..... F21V 33/00

[52] U.S. Cl. ..... 362/96; 362/192; 362/193; 362/249; 416/5

[58] Field of Search ..... 362/96, 192, 183, 362/249; 416/5

[56] References Cited

U.S. PATENT DOCUMENTS

| | | | |
|---|---|---|---|
| 4,616,298 | 10/1986 | Bolson | 362/192 |
| 5,743,628 | 4/1998 | Greif et al. | 362/228 |
| 5,765,940 | 6/1998 | Levy et al. | 362/240 |

*Primary Examiner*—Sandra O'Shea
*Assistant Examiner*—John A. Ward

[57] ABSTRACT

A wind powered lamp for generating light when moving air such as wind or a breeze passes over it. The lamp includes an elongate shaft having a first end mountable to a support structure. A generator for generating electrical energy is mounted to a second end of the shaft. The generator is rotatable about the longitudinal axis of the shaft to generate electrical power. A housing substantially encloses the generator. The housing has a plurality of rotor blades extending in a direction radially outwards from the longitudinal axis of the shaft. The housing is coupled to the generator such that rotation of the housing rotates the generator about the longitudinal axis of the shaft to generate electrical energy. A plurality of light sources are also substantially enclosed in the housing and are electrically connected to the generator.

8 Claims, 3 Drawing Sheets

WIND POWERED LAMP

BACKGROUND OF THE INVENTION

1. Field of the Invention

The present invention relates to self powering light generating devices and more particularly pertains to a new wind powered lamp for generating light when moving air such as wind or a breeze passes over it.

2. Description of the Prior Art

The use of self powering light generating devices is known in the prior art. More specifically, self powering light generating devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,805,329; U.S. Pat. No. 5,359,500; U.S. Pat. No. 4,315,301; U.S. Pat. No. 4,186,313; U.S. Pat. No. Des. 243,408; and U.S. Pat. No. 2,505,154.

While these devices fulfill their respective, particular objectives and requirements, the aforementioned patents do not disclose a new wind powered lamp. The inventive device includes an elongate shaft having a first end mountable to a support structure. A generator for generating electrical energy is mounted to a second end of the shaft. The generator is rotatable about the longitudinal axis of the shaft to generate electrical power. A housing substantially encloses the generator. The housing has a plurality of rotor blades extending in a direction radially outwards from the longitudinal axis of the shaft. The housing is coupled to the generator such that rotation of the housing rotates the generator about the longitudinal axis of the shaft to generate electrical energy. A plurality of light sources are also substantially enclosed in the housing and are electrically connected to the generator.

In these respects, the wind powered lamp according to the present invention substantially departs from the conventional concepts and designs of the prior art, and in so doing provides an apparatus primarily developed for the purpose of generating light when moving air such as wind or a breeze passes over it.

SUMMARY OF THE INVENTION

In view of the foregoing disadvantages inherent in the known types of self powering light generating devices now present in the prior art, the present invention provides a new wind powered lamp construction wherein the same can be utilized for generating light when moving air such as wind or a breeze passes over it.

The general purpose of the present invention, which will be described subsequently in greater detail, is to provide a new wind powered lamp apparatus and method which has many of the advantages of the self powering light generating devices mentioned heretofore and many novel features that result in a new wind powered lamp which is not anticipated, rendered obvious, suggested, or even implied by any of the prior art self powering light generating devices, either alone or in any combination thereof.

To attain this, the present invention generally comprises an elongate shaft having a first end mountable to a support structure. A generator for generating electrical energy is mounted to a second end of the shaft. The generator is rotatable about the longitudinal axis of the shaft to generate electrical power. A housing substantially encloses the generator. The housing has a plurality of rotor blades extending in a direction radially outwards from the longitudinal axis of the shaft. The housing is coupled to the generator such that rotation of the housing rotates the generator about the longitudinal axis of the shaft to generate electrical energy. A plurality of light sources are also substantially enclosed in the housing and are electrically connected to the generator.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new wind powered lamp apparatus and method which has many of the advantages of the self powering light generating devices mentioned heretofore and many novel features that result in a new wind powered lamp which is not anticipated, rendered obvious, suggested, or even implied by any of the prior art self powering light generating devices, either alone or in any combination thereof.

It is another object of the present invention to provide a new wind powered lamp which may be easily and efficiently manufactured and marketed.

It is a further object of the present invention to provide a new wind powered lamp which is of a durable and reliable construction.

An even further object of the present invention is to provide a new wind powered lamp which is susceptible of a low cost of manufacture with regard to both materials and labor, and which accordingly is then susceptible of low prices of sale to the consuming public, thereby making such wind powered lamp economically available to the buying public.

Still yet another object of the present invention is to provide a new wind powered lamp which provides in the apparatuses and methods of the prior art some of the advantages thereof, while simultaneously overcoming some of the disadvantages normally associated therewith.

Still another object of the present invention is to provide a new wind powered lamp for generating light when moving air such as wind or a breeze passes over it.

Yet another object of the present invention is to provide a new wind powered lamp which includes an elongate shaft having a first end mountable to a support structure. A generator for generating electrical energy is mounted to a second end of the shaft. The generator is rotatable about the longitudinal axis of the shaft to generate electrical power. A housing substantially encloses the generator. The housing has a plurality of rotor blades extending in a direction radially outwards from the longitudinal axis of the shaft. The housing is coupled to the generator such that rotation of the housing rotates the generator about the longitudinal axis of the shaft to generate electrical energy. A plurality of light sources are also substantially enclosed in the housing and are electrically connected to the generator.

Still yet another object of the present invention is to provide a new wind powered lamp that is self contained, and easily mountable to various structures. It can also be used in areas without electrical power from a battery or electrical outlet such as in a remote campsite.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
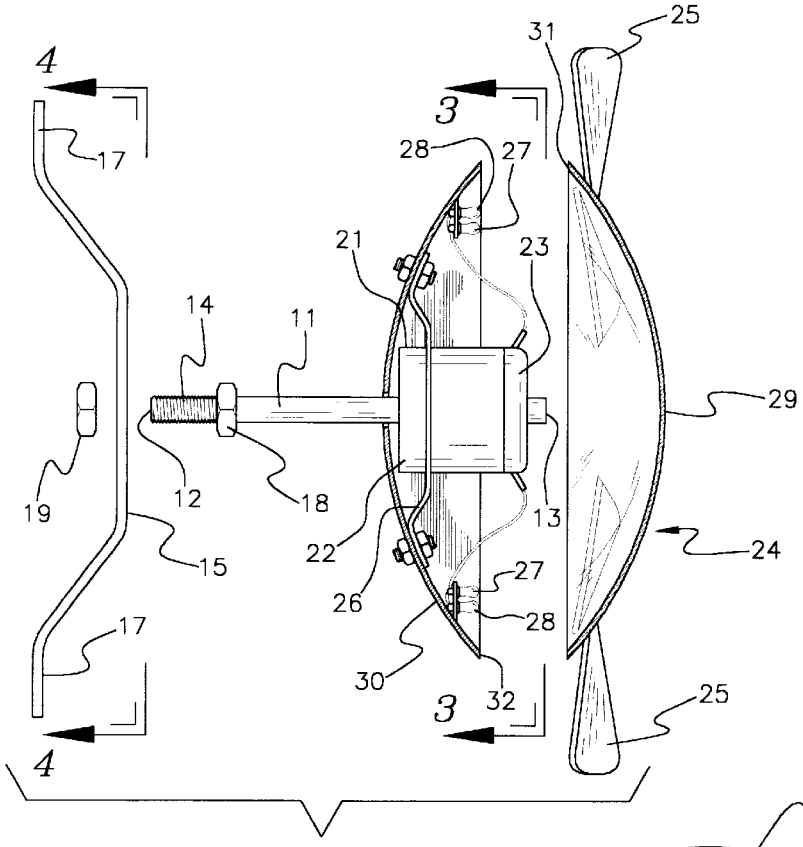
FIG. 1 is a schematic exploded cross sectional view of a new wind powered lamp according to the present invention.
Figure 2:
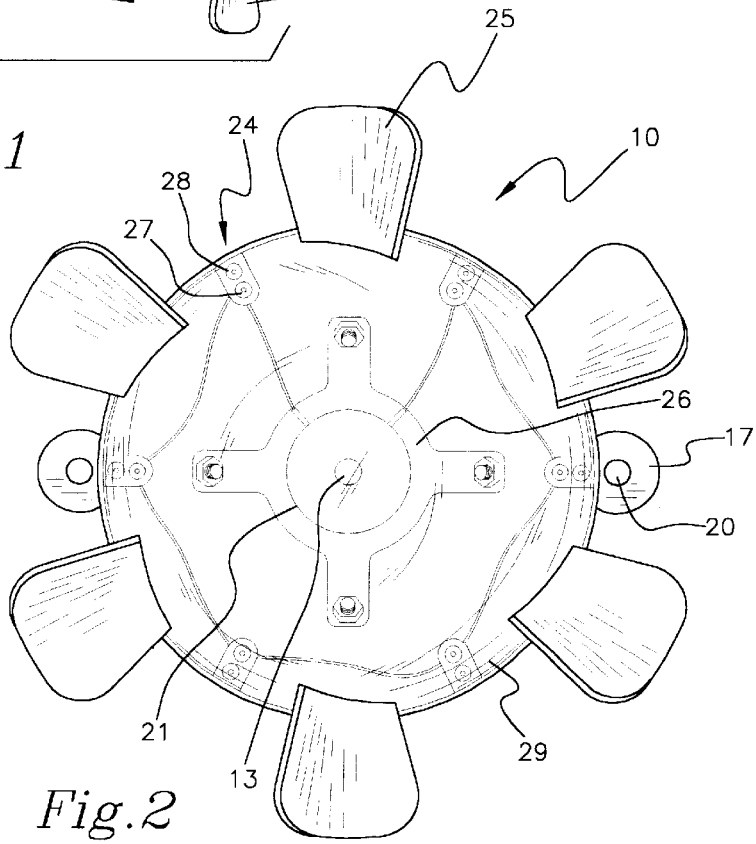
FIG. 2 is a schematic front plan view of the present invention.

With reference now to the drawings, and in particular to FIGS. 1 through 6 thereof, a new wind powered lamp embodying the principles and concepts of the present invention and generally designated by the reference numeral 10 will be described.

As best illustrated in FIGS. 1 through 6, the wind powered lamp 10 generally comprises an elongate shaft 11 having a first end 12 mountable to a support structure. A generator 21 for generating electrical energy is mounted to a second end 13 of the shaft 11. The generator 21 is rotatable about the longitudinal axis of the shaft 11 to generate electrical power. A housing 24 substantially encloses the generator 21. The housing 24 has a plurality of rotor blades 25 extending in a direction radially outwards from the longitudinal axis of the shaft 11. The housing 24 is coupled to the generator 21 such that rotation of the housing 24 rotates the generator 21 about the longitudinal axis of the shaft 11 to generate electrical energy. A plurality of light sources 27,28 are also substantially enclosed in the housing 24 and are electrically connected to the generator 21.

In closer detail, the elongate shaft 11 is preferably generally cylindrical and has opposite first and second ends 12,13, and a longitudinal axis extending between the first and second ends 12,13 of the shaft 11. The first end 12 of the shaft 11 is mountable to a support structure preferably by a mounting bracket 15 coupled to the first end 12 of the shaft 11. The mounting bracket 15 has a center hole 16 and a plurality of outwardly radiating mounting arms 17. The first end 12 of the shaft 11 is extended through the center hole 16 of the mounting bracket 15. A pair of nuts 18,19 are threaded onto a threaded portion 14 of the first end 12 of the shaft 11 with the mounting bracket 15 disposed between the nuts 18,19 on the shaft 11 so that the nuts 18,19 couple the mounting bracket 15 to the first end 12 of the shaft 11. The mounting arms 17 of the mounting bracket 15 are designed for mounting the mounting bracket 15 to a support structure. Each of the mounting arms 17 of the mounting bracket 15 has a hole 20 therethrough designed for extending fasteners therethrough to mount 26 the mounting arms 17 to the support structure.

A generator 21 for generating electrical energy when rotated is mounted to the second end 13 of the shaft 11. The generator 21 is rotatable about the longitudinal axis of the shaft 11 to generate electrical power as it is rotated. Preferably, the generator 21 has a rotating portion 22 and a fixed portion 23. The fixed portion 23 is fixedly coupled to the shaft 11 such that the rotating portion 22 of the generator 21 may rotate about the longitudinal axis of the shaft 11 to generate electrical energy. A housing 24 encloses the generator 21. The housing 24 has a plurality of rotor blades 25 extending in a direction radially outwards from the longitudinal axis of the shaft 11. In use, the rotor blades 25 are designed for rotating the housing 24 about the longitudinal axis of the shaft 11 by wind blowing against the rotor blades. The housing 24 is fixedly coupled to the generator 21 such that rotation of the housing 24 rotates the generator 21 about the longitudinal axis of the shaft 11 to generate electrical energy. Ideally, a mount 26 having a plurality of outwardly radiating arms couples the generator 21 to the housing 24 with threaded fasteners and nuts.

Figure 5:
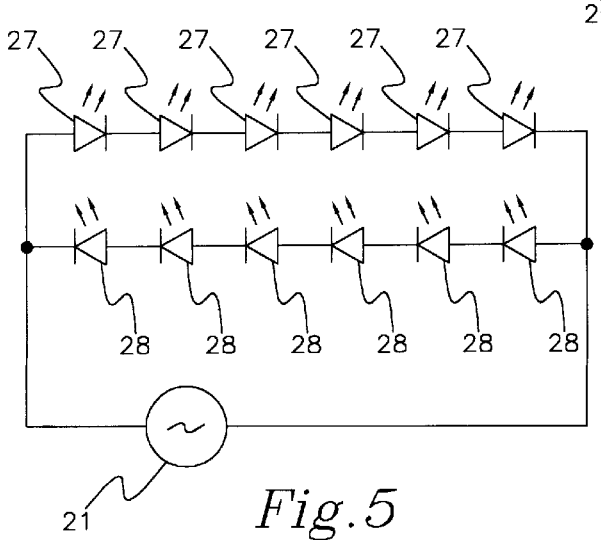
FIG. 5 is a schematic electrical diagram of the present invention.
Figure 6:
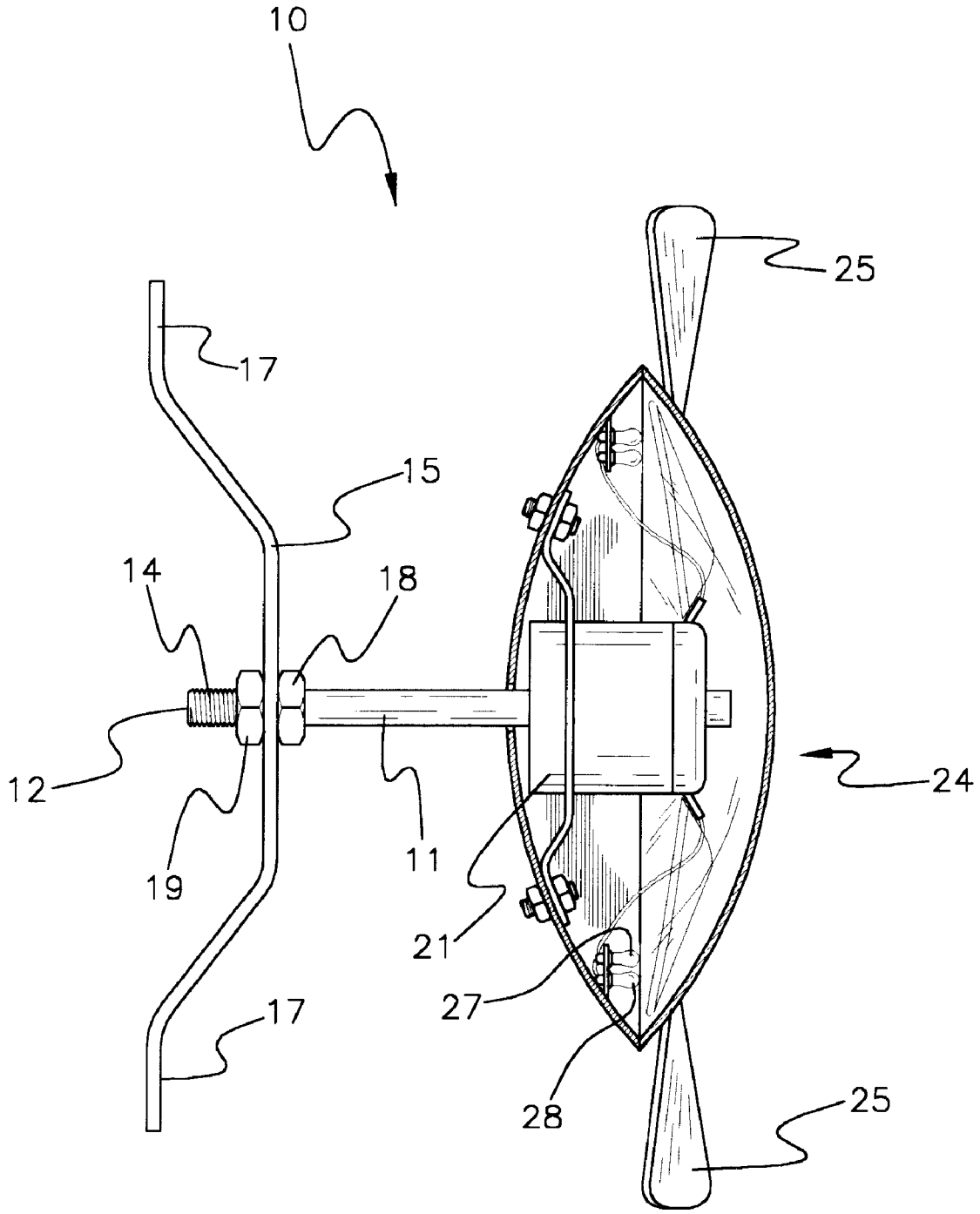
FIG. 6 is a schematic cross sectional view of the present invention.

A plurality of light sources 27,28 are enclosed in the housing 24. The light sources is electrically connected to the generator 21 such that electrical energy from the generator 21 illuminates the light sources. Preferably, each of the light sources comprises an LED. With particular reference to FIG. 5, the light sources are divided into first and second sets of light sources 27,28. Each light source of the first set of light sources 27 is paired with an associated light source of the second set of light sources 28. The light sources of the first set of light sources 27 are arranged in a first directional series and the light sources of the second set light sources is arranged in a second directional series opposite the first directional series such that rotation of the generator 21 in a first direction illuminates the light sources of the first set of light sources 27 and rotation of the generator 21 in a second direction illuminates the second set of light sources 28. This way if winds blow from opposite directions to thereby rotate the housing 24 in opposite directions, at least one set of light sources will be illuminated.

Figure 3:
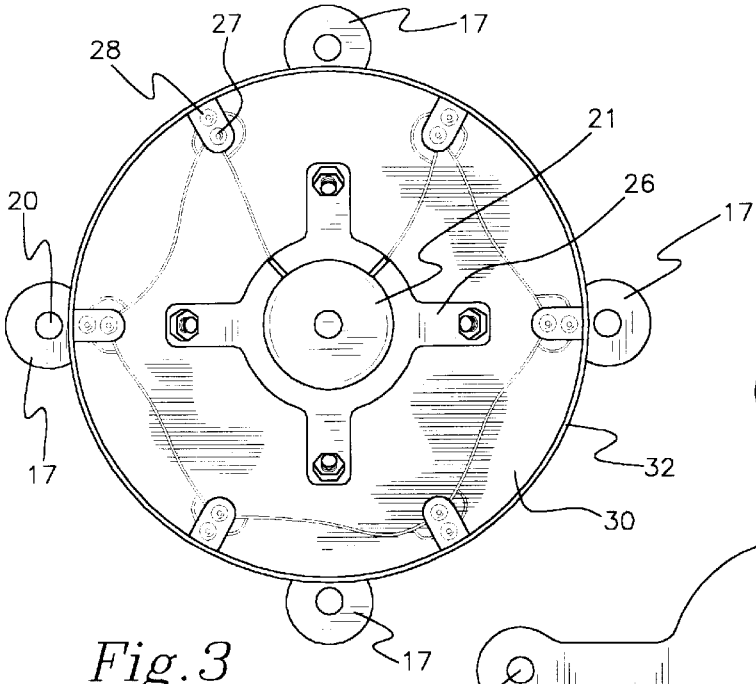
FIG. 3 is a schematic front plan view of the back portion of the housing of the present invention as seen from the vantage of line 3—3 of FIG. 1.
Figure 4:
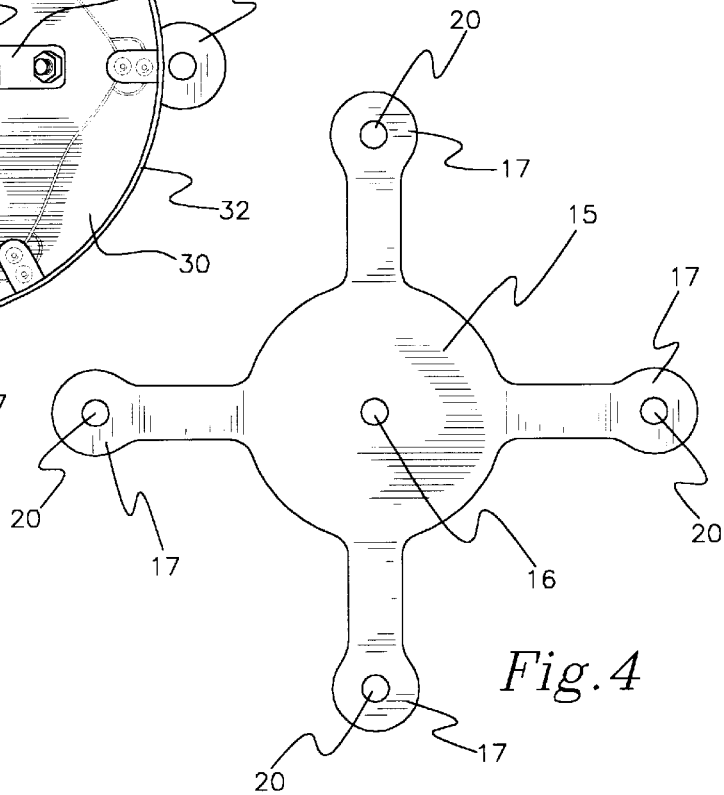
FIG. 4 is a schematic front plan view of the mounting bracket of the present invention as seen from the vantage of line 4—4 of FIG. 1.

The housing 24 is generally translucent to permit passage of light from the light sources out through the housing 24. Ideally, the housing 24 is generally transparent and comprises a generally clear plastic material. The housing 24 preferably has front and back portions 29,30 each having a generally arcuate cross section and a generally circular perimeter edge 31,32. The front and back portions 29,30 are coupled together along their perimeter edges 31,32. As illustrated in FIG. 3 the perimeter edge 32 of the back portion 30 of the housing 24 preferably has a diameter less than the distance across opposite mounting arms 17 of the mounting bracket 15. The rotor blades 25 are located on the front portion 29 of the housing 24 and extending outwards from the perimeter edge 31 of the front portion 29. The generator 21 is mounted to the back portion 30 of the housing 24. The back portion 30 also has a hole through which the shaft 11 extends. The light sources 27,28 are coupled to the inside of the back portion 30 of the housing 24. Each light source of the first set of light sources 27 is positioned adjacent the associated light source of the second set of light sources 28. The pairs of light sources are spaced apart from each other and arranged in a ring extending adjacent the outer perimeter of the back portion 30 of the housing 24.

In use, wind blows over the rotor blades to rotate the housing and thus the generator to generate electrical energy to illuminate the light sources.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A lamp, comprising:

an elongate shaft having opposite first and second ends, and a longitudinal axis extending between said first and second ends of said shaft;

said first end of said shaft being mountable to a support structure;

a generator for generating electrical energy being mounted to said second end of said shaft, said generator being rotatable about said longitudinal axis of said shaft to generate electrical power as it is rotated, said generator having a rotating portion and a fixed portion, said fixed portion being fixedly coupled to said shaft such that said rotating portion of aid generator may rotate about said longitudinal axis of said shaft to generate electrical energy;

a housing substantially enclosing said generator, said housing having a plurality of rotor blades extending in a direction radially outwards from said longitudinal axis of said shaft;

said housing being coupled to said generator such that rotation of said housing rotates said generator about said longitudinal axis of said shaft to generate electrical energy; and a plurality of light sources being enclosed in said housing, said light sources being electrically connected to said generator.

2. The lamp of claim 1, further comprising a mounting bracket being coupled to said first end of said shaft, said mounting bracket having a plurality of outwardly radiating mounting arms adapted for mounting said mounting bracket to a support structure.

3. The lamp of claim 1, wherein each of said light sources comprises an LED.

4. The lamp of claim 1, wherein said light sources are divided into first and second sets of light sources, each light source of said first set of light sources being paired with an associated light source of said second set of light sources, said light sources of said first set of light sources being arranged in a first directional series and said light sources of said second set light sources being arranged in a second directional series opposite said first directional series such that rotation of said generator in a first direction illuminates said light sources of said first set of light sources and rotation of said generator in a second direction illuminates said second set of light sources.

5. The lamp of claim 1, wherein said housing has a rotatable front portion forming a rotating hub with the rotor blades mounted thereon, wherein said rotating hub is generally translucent to permit passage of light from said light sources through rotating hub of said housing for permitting light from said light sources to permit passage of light through the rotating hub.

6. The lamp of claim 1, wherein said housing has a rotatable front portion forming a rotating hub with the rotor blades mounted thereon, wherein said rotating hub is generally transparent for permitting light from said light sources to permit passage of light through the rotating hub.

7. The lamp of claim 1, wherein said housing has front and back portions, said rotor blades being located on said front portion of said housing, said generator being mounted to said back portion of said housing, said light sources being coupled to of said back portion of said housing.

8. A lamp, comprising:

an elongate shaft being generally cylindrical and having opposite first and second ends, and a longitudinal axis extending between said first and second ends of said shaft;

said first end of said shaft being mountable to a support structure, said first end of said shaft being threaded;

a mounting bracket being coupled to said first end of said shaft, said mounting bracket having a center hole and a plurality of outwardly radiating mounting arms, said first end of said shaft being extended through said center hole of said mounting bracket;

a pair of nuts being threaded onto said first end of said shaft, said mounting bracket being disposed between said nuts on said shaft such that said nuts couple said mounting bracket to said first end of said shaft;

said mounting arms of said mounting bracket being adapted for mounting said mounting bracket to a support structure, each of said mounting arms of said mounting bracket having a hole therethrough, each of said holes of said mounting arms of said mounting bracket being adapted for extending fasteners therethrough to mount said mounting arms to the support structure;

a generator for generating electrical energy being mounted to said second end of said shaft, said generator being rotatable about said longitudinal axis of said shaft to generate electrical power as it is rotated, said generator having a rotating portion and a fixed portion, said fixed portion being fixedly coupled to said shaft such that said rotating portion of aid generator may rotate about said longitudinal axis of said shaft to generate electrical energy;

a housing enclosing said generator, said housing having a plurality of rotor blades extending in a direction radially outwards from said longitudinal axis of said shaft, said rotor blades being adapted for rotating said housing about said longitudinal axis of said shaft by a wind;

said housing being coupled to said generator such that rotation of said housing rotates said generator about said longitudinal axis of said shaft to generate electrical energy, wherein a mount has a plurality of outwardly radiating arms coupled to said generator and to said housing with threaded fasteners and nuts;

a plurality of light sources being enclosed in said housing, said light sources being electrically connected to said generator, wherein each of said light sources comprises an LED;

said light sources being divided into first and second sets of light sources, each light source of said first set of light sources being paired with an associated light source of said second set of light sources, said light sources of said first set of light sources being arranged in a first directional series and said light sources of said second set light sources being arranged in a second directional series opposite said first directional series such that rotation of said generator in a first direction illuminates said light sources of said first set of light sources and rotation of said generator in a second direction illuminates said second set of light sources;

said housing being generally translucent to permit passage of light from said light sources through said housing;

said housing having front and back portions each having a generally arcuate cross section and a generally circular perimeter edge, said perimeter edges of said front and back portions being coupled together therearound, said perimeter edge of said back portion of housing having a diameter less than the distance across opposite mounting arms of said mounting bracket;

said rotor blades being located on said front portion of said housing;

said generator being mounted to said back portion of said housing; and said light sources being coupled to of said back portion of said housing, each light source of said first set of light sources being positioned adjacent the associated light source of said second set of light sources, said pairs of said light sources being spaced apart from each other and arranged in a ring extending adjacent said outer perimeter of said back portion of said housing.

* * * * *